United States Patent [19]

Fujiwara

[11] Patent Number: 4,632,305

[45] Date of Patent: Dec. 30, 1986

[54] EXPANSION VALVE

[75] Inventor: Kenichi Fujiwara, Kariya, Japan

[73] Assignee: Nippondenso Co., Ltd., Kariya, Japan

[21] Appl. No.: 774,522

[22] Filed: Sep. 10, 1985

[30] Foreign Application Priority Data

Sep. 12, 1984 [JP] Japan ..... 59-190860

[51] Int. Cl.[4] ..... F25B 41/04

[52] U.S. Cl. ..... 236/92 B; 62/210; 62/225

[58] Field of Search ..... 62/225, 217, 210; 236/92 B, 99 R; 60/530, 531; 374/201-203; 337/307, 320, 321; 200/83 Q, 83 Y, 83 D

[56] References Cited

U.S. PATENT DOCUMENTS

| | | | |
|---|---|---|---|
| 2,140,947 | 12/1938 | Andersson et al. | 236/99 R |
| 2,363,451 | 11/1944 | Stockestrom | 60/530 |
| 2,368,592 | 1/1945 | Dillman | 236/92 B X |
| 2,472,149 | 6/1949 | Dillman | 236/92 B |
| 2,487,946 | 11/1949 | Senn | 60/530 |
| 2,701,451 | 2/1955 | Candor | 236/92 B X |
| 2,711,184 | 6/1955 | Ehlke | 236/99 R X |
| 2,752,457 | 6/1956 | Matthews | 337/307 |
| 2,971,348 | 2/1961 | Orth | 62/225 |
| 3,534,611 | 10/1970 | Hilgert | 374/201 X |
| 4,158,437 | 6/1979 | Nielsen | 236/92 B |

FOREIGN PATENT DOCUMENTS

| | | | |
|---|---|---|---|
| 58-5161 | 1/1983 | Japan | 236/92 B |
| 821760 | 10/1959 | United Kingdom | 236/92 B |

*Primary Examiner*—William E. Wayner

*Attorney, Agent, or Firm*—Cushman, Darby & Cushman

[57] ABSTRACT

An expansion valve associated with an evaporator in a refrigerating system comprises a valve housing; a closure cap secured to the valve housing; a diaphragm assembly which is disposed in the valve housing and includes a first and a second diaphragm members which are spaced from each other to define a first working chamber therebetween, the diaphragm assembly cooperating with the closure cap to define a second working chamber therebetween, and the first diaphragm member being affected by a refrigerant pressure; a remote sensing bulb; a capillary tube communicating the second working chamber to said bulb; a working gas for moving the diaphragm assembly; a spring urging the first diaphragm member on against the movement of the diaphragm assembly towards the spring; a valve element moved by a difference between the forces caused by the spring and the diaphragm assembly movement; and an inert gas filling the first working chamber with a pressure level higher than a pressure level caused by the spring against the diaphragm assembly.

5 Claims, 5 Drawing Figures

EXPANSION VALVE

FIELD OF THE INVENTION AND RELATED ART STATEMENT

The present invention relates to an expansion valve for controlling a refrigerant flow to be fed to an evaporator in a refrigerating system.

In a refrigeration system, an expansion valve serves to control a refrigerant flow to be fed to an evaporator according to a variation of heating load. As such an expansion valve, there have been known a thermostatic type one which operates in accordance with a variation of refrigeration load, a constant pressure type one which keeps an evaporative pressure of refrigerant within the evaporator constant, and a float type one.

Since a thermostatic type expansion valve has a high sensitivity over a wide range of heating load, the valve well operates in a transitional state of the refrigeration system operation. However, in a steady state of the refrigeration system operation, as the refrigeration load is decreased, the evaporative pressure of refrigerant within the evaporator is also decreased. Therefore, the refrigerant temperature is lowered to cause a problem that the evaporator frosts over. In order to obviate such a problem, an evaporator pressure regulator is required to be interposed between an evaporator and a compressor in refrigeration system. The regulator serves to throttle the refrigerant flow to be returned back to the compressor to prevent the evaporative pressure of refrigerant within the evaporator from being lowered below a predetermined level, thereby avoiding generation of frost in the evaporator.

On the other hand, the constant pressure type expansion valve may keep the evaporative pressure of refrigerant within the evaporator constant. Therefore, this makes it possible to overcome the frost problem of the evaporator which is inherent in the thermostatic type expansion valve, and makes it unnecessary to provide any additional evaporator pressure regulator. However, since the evaporative pressure is kept constant irrespective of the refrigeration load, the amount of refrigerant to be fed to the evaporator would be insufficient when the refrigeration load is at a higher level. This results in poor refrigeration ability.

In order to overcome these problems, it has been proposed to provide an expansion valve, disclosed in Japanese Utility Model Examined Publication No. 5161/83, which serves as a thermostatic type expansion valve during a transitional state of refrigeration system operation, i.e., during a large change of heating load, and serves as a constant pressure type expansion valve during a steady state of operation, i.e., during a small change of heating load. However, the expansion valve needs a bellows member, a plunger, an additional spring and so on as well as a diaphragm assembly. The construction thereof is to be more complicated and the manufacturing cost thereof is also increased.

SUMMARY OF THE INVENTION

An object of the present invention is to provide an expansion valve which overcomes the above-mentioned problems.

According to the present invention, this and other objects are attained by providing an expansion valve having a simplified construction, which serves as a thermostatic type expansion valve during a large change of refrigeration load, e.g., a transitional state of the refrigeration system operation and serves, on the contrary, as a constant pressure type expansion valve during a small change of refrigeration load, e.g., a steady state of the refrigeration system operation.

The present invention will become more apparent from the following description of preferred embodiments in connection with the accompanying drawings.

DETAILED DESCRIPTION OF THE PREFERRED EMBODIMENTS

Figure 1:
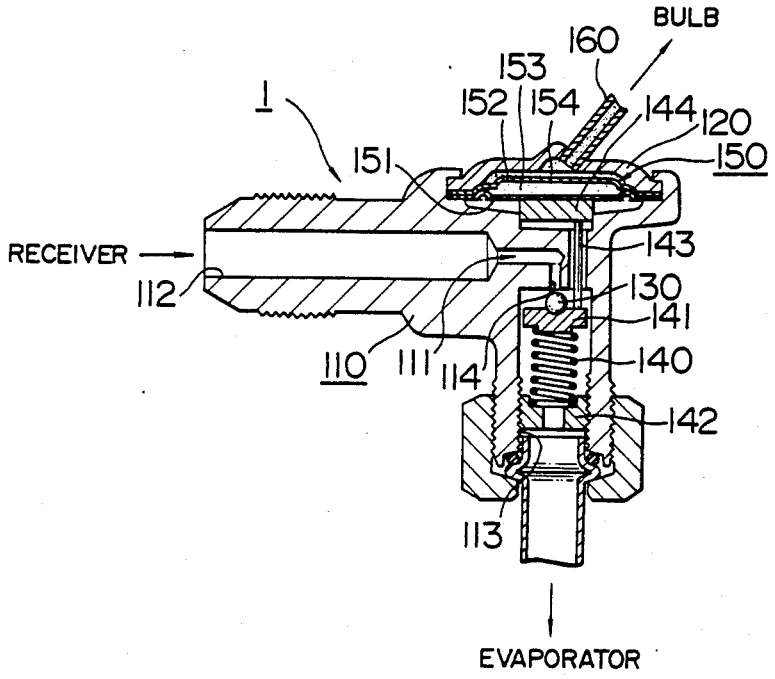
FIG. 1 is a cross-sectional view showing one embodiment of the present invention.
Figure 2:
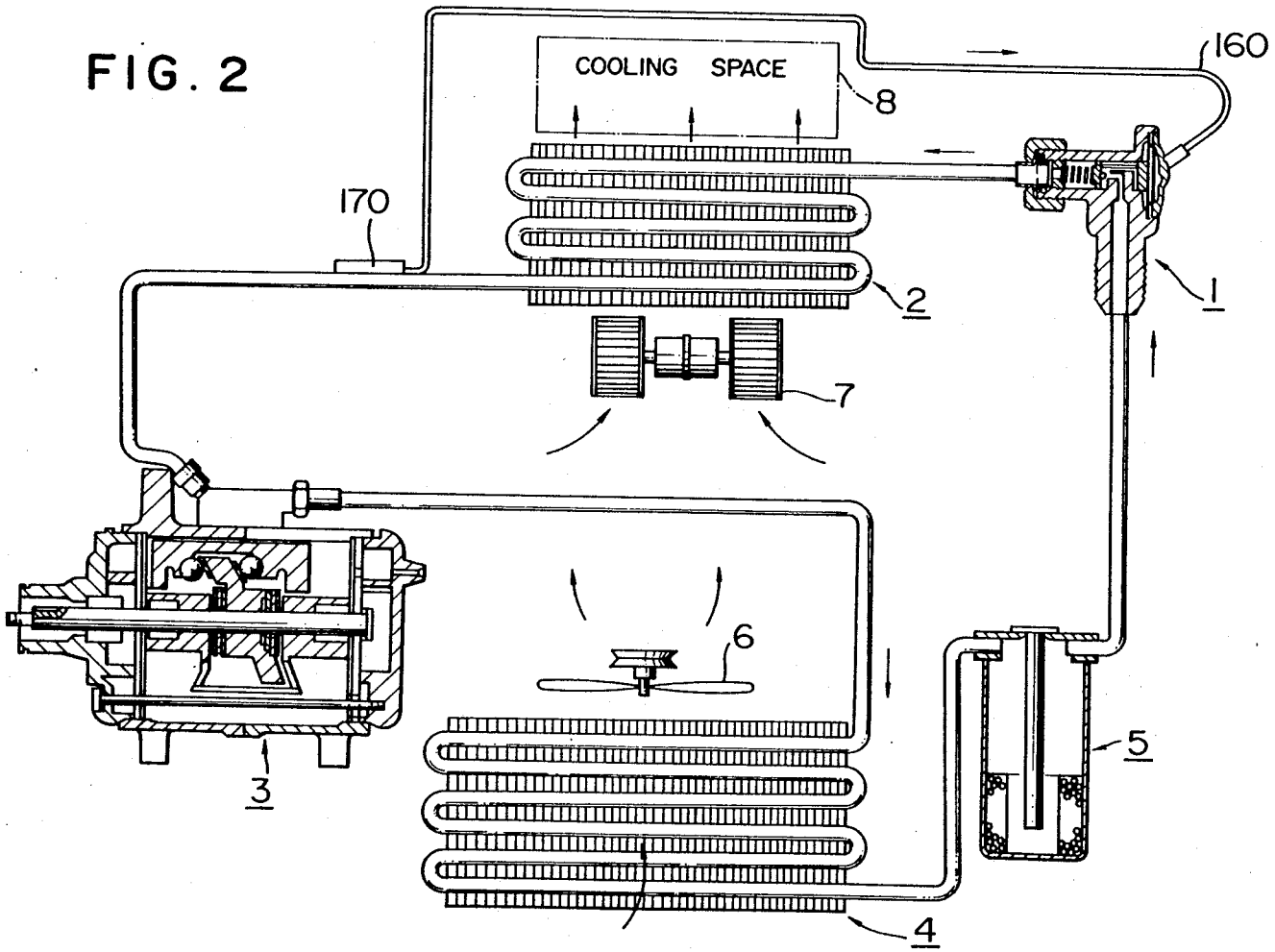
FIG. 2 is a view showing an automotive refrigeration system to which the expansion valve shown in FIG. 1 is applied.

Referring now to FIG. 1, there is shown an expansion valve 1 which is applied to a refrigeration system shown in FIG. 2, in accordance with one embodiment of the present invention.

The refrigerator system shown in FIG. 2 includes an expansion valve 1, an evaporator 2, a compressor 3, a condenser 4 and a receiver 5. The compressor 3 compresses gaseous refrigerant into high pressure and high temperature gaseous refrigerant, and pumps it into the condenser 4 through a discharge line. In the condenser 4, the high pressure and high temperature gaseous refrigerant is cooled by air sucked from the outside of the automotive body through a fan 6 and is condensed into high pressure liquid refrigerant.

The expansion valve 1 allows the high pressure liquid refrigerant passing from the receiver 5 to rapidly expand into low pressure and low temperature gaseous and liquid refrigerant. At the same time, the expansion valve 1 controls the amount of refrigerant to be fed to the evaporator 2 in response to the change of heat load. The refrigerant fed from the expansion valve 1 is evaporated within the evaporator 2 and is converted into gaseous refrigerant. There is provided with a blower 7 which is associated with the evaporator 2. The blower 7 supplys air to a cooling space 8, e.g. a refrigerator mounted on an automobile through the vaporator 2. The evaporation of refrigerant within the evaporator 2 removes a heat from the air to be supplied to the cooling space 8 and cools an interior of the space 8. The evaporated gaseous refrigerant is returned back to the compressor 3 and then a refrigerating cycle is completed.

The expansion valve 1 shown in FIG. 1 will be explained hereinafter in greater detail. The expansion valve 1 includes a valve housing 110 and a closure cap 120. A refrigerant passage 111 is formed in the valve housing 110 to communicate a refrigerant inlet port 112 to a refrigerant outlet port 113. An orifice 114 is formed in the refrigerant passage 111.

Reference numeral 130 designates a ball valve element disposed in the refrigerant passage 111. The ball 130 cooperates with the orifice 114 to change an opening degree of the refrigerant passage 111, thereby controlling the flow of refrigerant to be fed to the evaporator 2 through the outlet port 113. The ball 130 is fixed to a ball retainer 141 attached to one end of a spring 140.

The other end of the spring 140 is retained at a spring retainer 142 which is screw mounted for axial movement within the valve housing 110. A rigid connecting rod 143 which is fixed at one end thereof to the ball retainer 141 extends to an attachment 144 fixed to a diaphragm assembly 150.

The diaphragm assembly 150 comprises two metallic diaphragm members 151, 152 made of, for example, baryllium copper. The diaphragm members 151, 152 are spaced from each other to defined a first working chamber 153 therebetween. The peripheries of the diaphragm members 151, 152 are clamped together between the valve housing 110 and the closure cap 120. The attachment 144 is fixed to the first diaphram member 151 of the diaphragm assembly 150. A second working chamber 154 is defined between the second diaphragm member 152 of the diaphragm assembly 150 and the closure cap 120. A capillary tube 160 communicates an interior of the second working chamber 154 to an interior of a bulb 170 (shown in FIG. 2) disposed at an outlet portion of the evaporator 2 for sensing a temperature of the refrigerant leaving the evaporator 2. The first working chamber 153 is filled with inert gas, e.g., nitrogen gas kept at a pressure of $9.8\times10^4$ Pa. The second working chamber 154, the capillary tube 160 and the bulb 170 are filled with working gas, e.g. freon gas which is the same as refrigerant of the refrigeranting system.

The operation of the above-mentioned expansion valve 1 will now be described with reference to FIGS. 1 to 3.

In case the temperature of the refrigerant leaving the evaporator 2 is not high, since the pressure of the inert gas in the first working chamber 153 is higher than the pressure of the working gas in the second working chamber 154, the seond diaphragm member 152 is kept in contact with the closure cap 120.

However, since the refrigerating load (heat load) against the evaporator 2 is large immediately after the start of the operation of the refrigerating system shown in FIG. 2, it is required to supply a larger amount of refrigerant to the evaporator 2. In other words, the temperature of the refrigerant leaving the evaporator 2 is high at an initial period of the operation of the refrigerating system. Therefore, the working gas within the bulb 170 is heated and expanded. The pressure of the working gas affects the second diaphragm member 152 of the diaphragm assembly 150 through the capillary tube 160 and the second working chamber 154. Therefore, the second diaphragm member 152 is shifted inwardly until the pressure of the inert gas within the first working chamber 153 becomes the same as the pressure of the working gas. As a result, the first diaphragm member 151 is subjected to a pressure which is the same as the pressure of the working gas. Accordingly, the diaphragm assembly 150 as a whole presses at a pressure corresponding to the working gas pressure the ball retainer 141 against the spring force exerted by the spring 140, thereby separating the ball 130 from the orifice 114. Thus, a larger amount of refrigerant is fed to the evaporator 2. At this time, the expansion valve 1 serves as a thermostatic expansion valve.

Figure 3:
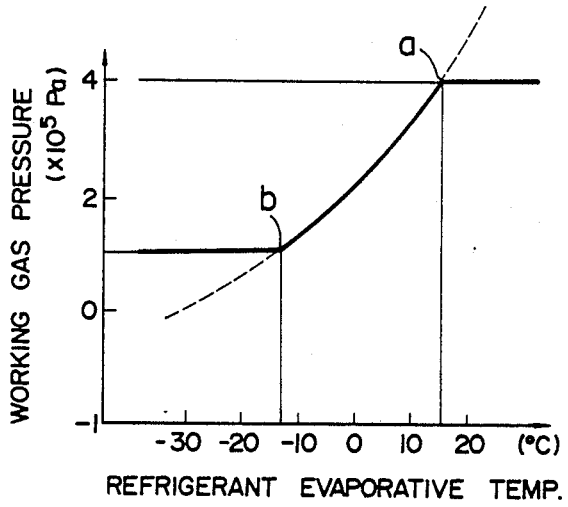
FIG. 3 is a graph showing a relationship between the working gas pressure and the refrigerant evaporative temperature.

When the operation of the refrigerating system is continued, the temperature of the refrigerant leaving the evaporator 2 is lowered (as shown by the point a to the point b in FIG. 3). As a result, the pressure of the working gas is also reduced. When the temperature of the refrigerant leaving the evaporator 2 is lowered to −13° C. (at the point b in FIG. 3), both the working gas pressure and the inert gas pressure are at $9.8\times10^4$ Pa and the second diaphragm member 152 is brought into contact with the closure cap 120 and is remained stationary.

When the temperature of the refrigerant leaving the evaporator 2 is lower below −13° C., the second diaphragm member 152 is remained stationary but the first diaphragm member 151 is shifted in accordance with a difference between the internal inert gas pressure, i.e., $9.8\times10^4$ Pa, and the external pressure caused by the refrigerant evaporative pressure and the urging pressure of a spring force from the spring 140. The movement of the first diaphragm member 151 is transmitted to the ball retainer 141 through the connecting rod 143 to change the opening degree of the refrigerant passage 111. The spring 140 is pre-loaded by means of adjusting the spring retainer 142 so that a pressure of $4.9\times10^4$ Pa is applied to the first diaphragm member 151, and the first working chamber 153 is filled with the inert gas at a pressure of $9.8\times10^4$ Pa. Accordingly, when the refrigerant evaporative pressure affecting the first diaphragm member 151 is lower than $4.9\times10^4$ Pa; that is, when the total external pressure applied to the first diaphragm member 151 is less than the internal inert gas pressure, i.e., $9.8\times10^4$ Pa, the first diaphragm member 151 operates on the ball 130 so as to increase the opening degree of the refrigerant passage. As a result, a greater amount of the refrigerant is fed into the evaporator 2 to increase the refrigerant evaporative pressure. However, when the refrigerant evaporative pressure is raised to around $4.9\times10^4$ Pa, the opening degree of the refrigerant passage is, to the contray, reduced. Accordingly, the amount of the refrigerant to be fed into the evaporator is decreased, so that the increase of the refrigerant evaporative pressure is suppressed. Therefore, the refrigerant evaporative pressure is kept substantially constant at $4.9\times10^4$ Pa. In this case, the expansion valve 1 serves as a constant pressure expansion valve.

As described above, the expansion valve 1 in accordance with the present invention serves as a thermostatic expansion valve at a higher refrigeration load or in a transitional state, e.g., immediately after the start of operation of the refrigerating system, and serves as a constant pressure expansion valve at a small change of refrigeration load or in a steady state.

Figure 4:
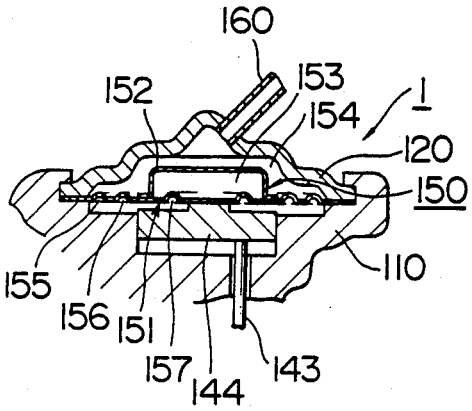
FIGS. 4 and 5 are partially fragmentary sectional views showing other embodiments, respectively.
Figure 5:
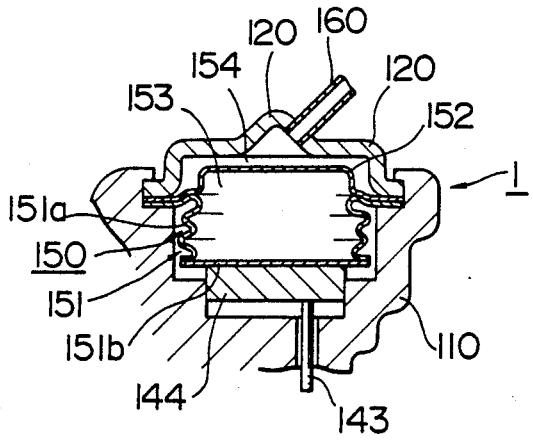

FIGS. 4 and 5 show other embodiments, respectively, in which the same reference numerals are used to designate the same or like members or components shown in FIG. 1.

The expansion valve 1 shown in FIG. 4 includes a diaphragm assembly 150 having a first diaphragm member 151, a periphery of which is clamped between the closure cap 120 and the valve housing 110, and a cup-shaped second diaphragm member 152 bonded to the first diaphragm 151.

The first diaphragm member 151 is provided at a radial outer portion thereof with first and second concentric annular recesses 155, 156 for facilitating a synchronous movement of the first and second diaphragm members 151, 152 caused by the working gas pressure when the valve 1 operates as the thermostatic expansion valve. Further, the first diaphragm member 151 is provided with a third annular recess 157 concentrical with the second annular recess 156. An opening mouth of the cup-shaped second diaphragm member 152 is disposed, between the third annular recess 157 and the second recess 156. The third annular recess 157 facilitates the movement of the first diaphragm member 151 due to the inert gas pressure within the first working chamber 153 when the valve 1 operates as the constant pressure expansion valve. With such a construction, it is possible to make the second diaphragm member 152 rigid and it is easy to manufacture the diaphragm assembly.

In the expansion valve shown in FIG. 5, a diaphragm assembly 150 includes a flexible first diaphragm member 151 consisting of tubular bellows portion 151*a* and end disk 151*b* secured to one end of the tubular bellows portion 151*a*, and a washbasin-shaped second diaphragm member 152. The peripheries of both diaphragm members 151, 152 are clamped together between the valve housing 110 and the closure cap 120. In the case where the valve 1 operates as the thermostatic expansion valve, the first and second diaphragm members 151, 152 synchronously move. In the case where the valve operates as the constant pressure expansion valve, the second diaphragm member 152 is brought into contact with the closure cap 120 and remained stationary by the internal inert gas pressure, and the end disk 151*b* of the first diaphragm member 151 is moved solely through the bellows portion 151*a* by the differential pressure between the internal inert gas pressure and the external pressure caused by the evaporative refrigerant pressure and the urging pressure of the spring force from the spring 140.

Although, in the foregoing embodiments, the first diaphragm member 151 and the second diaphragm member 152 are in direct contact with each other at their peripheral portions, it may be possible to interpose a discrete member therebetween if there is no problem in sealing.

Although the present invention has been explained as to the embodiments applied to the automotive refrigerating system, it is apparent that the expansion valve in accordance with the present invention is applicable to an automotive air-conditioning system.

What is claimed is:

1. An expansion valve associated with an evaporator in a refrigerating system, said valve comprising:

a valve housing provided with an inlet port and an outlet port, and provided therein with a refrigerant passage communicating said inlet portion to said outlet port;

a closure cap secured to said valve housing;

diaphragm means disposed in said valve housing, said diaphragm means including a first and a second diaphragm members which are spaced from each other to define a first working chamber therebetween, said diaphragm means cooperating with said closure cap to define a second working chamber therebetween, and said first diaphragm member being affected by a refrigerant pressure;

a remote sensing bulb for sensing a temperature of the refrigerant leaving said evaporator, said bulb being disposed in an outlet portion of said evaporator;

a capillary tube communicating said second working chamber to said bulb;

spring means disposed in said valve housing, which is loaded to urge said first diaphragm member on against the movement of said diaphragm means towards said spring means;

a valve element disposed in said refrigerant passage, said valve element being moved by a difference between an urging force of said spring means and an force caused by the movement of said diaphragm means to change an opening degree of said refrigerant passage;

an inert gas filling said first working chamber with a pressure level higher than a pressure level caused by said spring means against said diaphragm means; and a working gas filling said second working chamber, said capillary tube and said bulb, said working gas moving said diaphragm means as the temperature of the working gas increases, said working gas in said second working chamber having a first gas pressure keeping said second diaphragm member apart from said closure cap when the temperature of refrigerant sensed by said bulb is higher than a predetermined level, whereby said diaphragm means move to change the opening degree of said refrigerant passage in accordance with the first gas pressure in said second working chamber, and said working gas in said second working chamber having a second gas pressure when the temperature of refrigerant sensed by said bulb is lower than said predetermined level, against which second gas pressure said spring means urges said second diaphragm member to keep in contact with said closure cap, whereby said first diaphragm member moves to change the opening degree of said refrigerant passage in accordance with a gas pressure in said first working chamber regardless of the temperature of refrigerant.

2. An expansion valve according to claim 1, wherein said second working chamber is defined between said closure cap and said second diaphragm member, and wherein said first and second diaphragm members are clamped together at peripheries thereof between said valve housing and said closure cap.

3. An expansion valve according to claim 2, wherein said first diaphragm member comprises an end disk portion and a tubular bellows portion which is secured at one end thereof to said end disk portion.

4. An expansion valve according to claim 1, wherein said first diaphragm member is clamped at a periphery thereof between said valve housing and said closure cap, and is provided therein with concentric annular recesses, and wherein said second diaphragm member is made rigidly and has a cup-shape, and an annular opening mouth of said second diaphragm member is secured to a portion of said first diaphragm member between said annular recesses.

5. An expansion valve according to claim 1, wherein said valve element is a ball, and wherein said spring means include a spring, a retainer member for said ball, which is mounted on a one end of said spring, an attachment member secured to said first diaphragm member, and a rod connecting said retainer member to said attachment member.

* * * * *